United States Patent [19]

Heimberger

[11] 4,134,185

[45] Jan. 16, 1979

[54] WARP-KNIT SLIDE-FASTENER STRINGER HALF AND METHOD OF MAKING SAME

[75] Inventor: Helmut Heimberger, Locarno, Switzerland

[73] Assignee: Optilon W. Erich Heilmann GmbH, Cham, Switzerland

[21] Appl. No.: 837,467

[22] Filed: Sep. 28, 1977

Related U.S. Application Data

[63] Continuation-in-part of Ser. No. 728,136, Sep. 30, 1976, abandoned.

[30] Foreign Application Priority Data

Apr. 7, 1976 [DE] Fed. Rep. of Germany ..... 2614905

[51] Int. Cl.[2] ..... A44B 19/00

[52] U.S. Cl. ..... 24/205.16 C; 66/193

[58] Field of Search ..... 66/190–195; 24/205.1 R, 205.13, 205.16 C

[56] References Cited

U.S. PATENT DOCUMENTS

| | | | |
|---|---|---|---|
| 3,448,595 | 6/1969 | Baltler et al. | 66/195 |
| 3,685,474 | 8/1972 | Frohlich et al. | 66/86 X |
| 3,714,683 | 2/1973 | Frohlich et al. | 66/195 X |
| 3,757,541 | 9/1973 | Frohlich et al. | 66/193 |
| 3,881,473 | 5/1975 | Corvi et al. | 66/195 |
| 4,002,045 | 1/1977 | Frohlich et al. | 66/195 X |

FOREIGN PATENT DOCUMENTS 2200444 7/1973 Fed. Rep. of Germany .... 24/205.16 C

OTHER PUBLICATIONS

Paling, D. F. "Warp Knitting Technology" 2nd ed., London, 11-2-65, p. 173.

Reisfeld, A. "Warp Knit Engineering", N.Y. Nat. KTP Outerwear Assoc., 1966, pp. 338, 344, 346.

*Primary Examiner*—Ronald Feldbaum

*Attorney, Agent, or Firm*—Karl F. Ross

[57] ABSTRACT

A warp-knit slide-fastener stringer half comprises an elongated warp-knitted tape having a pair of opposite faces and a pair of opposite longitudinally extending edges. The tape is knit with a plurality of warp yarns forming longitudinally extending parallel wale-forming chains, a first group of weft yarns laid into and each extending over only three of the chains, and a second group of weft yarns laid into and each extending over only two of the chains. A continuous monofilamentary coupling element having a succession of turns lies on one face of the tape along one edge thereof and is secured thereto by double-lock stitching which overlies the turns, extends through the tape and has a needle thread on the other face of the tape between two of the wales formed by the chains at the edge. The warp-chain-forming yarns and the weft yarns or either of these in the alternative can be composed of shrinkable threads and thermofixed.

6 Claims, 6 Drawing Figures

WARP-KNIT SLIDE-FASTENER STRINGER HALF AND METHOD OF MAKING SAME

CROSS-REFERENCE TO RELATED APPLICATIONS

This application is a continuation in part of Ser. No. 728,136 filed Sept. 30, 1976 now abandoned.

Application Ser. No. 728,136, in turn, has reference to my applications:

- Ser. No. 728,032 filed Sept. 30, 1976, now U.S. Pat. No. 4,064,602, issued Dec. 27, 1977;
- Ser. No. 728,134 filed Sept. 30, 1976 now abandoned;
- Ser. No. 728,033 filed Sept. 30, 1976 now abandoned;
- Ser. No. 728,135 filed Sept. 30, 1976 now abandoned;
- Ser. No. 728,034 filed Sept. 30, 1976 U.S. Pat. No. 4,075,874 issued Feb. 28, 1978, (a continuation in part of which was filed June 6, 1977 as Ser. No. 803,312);
- Ser. No. 728,133 filed Sept. 30, 1976 and issued as U.S. Pat. No. 4,043, 007 on Aug. 23, 1977;
- Ser. No. 728,035 filed Sept. 30, 1976 now abandoned;
- Ser. No. 728,031 filed Sept. 30, 1976 and issued as U.S. Pat. No. 4,067,208 on Jan. 10, 1978; and
- Ser. No. 728,132 filed Sept. 30, 1976 and issued as U.S. Pat. No. 4,051,579 on Oct. 4, 1977.

FIELD OF THE INVENTION

The present invention relates to a slide-fastener stringer half. More particularly this invention concerns a stringer half having a warp-knitted tape with a monofilamentary coupling element stitched thereto.

BACKGROUND OF THE INVENTION

It is known to warp knit a support tape for a slide-fastener stringer half. This tape has a pair of parallel longitudinal edges and a pair of opposite faces. A monofilamentary coupling element having a succession of like turns is laid on one face at one edge thereof and stitched to the tape. The stitching is typically a multithread double chain stitch or double-lock stitch of class 400 (Federal Standard 751*a*).

Such stringer halves have shown themselves to give long service. They have relatively good transverse and longitudinal dimensional stability and are relatively wear resistant. Nonetheless in most of these arrangements the warp yarns, that is the filaments running mainly longitudinally, form chains into which a group of weft yarns, that is filaments running mainly transversely, are laid. These weft filaments are invariably laid in over at least four chains (see German open application DT-OS 2,016,141 and U.S. Pat. No. 3,708,836), so as to give maximum transverse dimensional stability.

More particularly, in this arrangement, the wales are of the single-bar type formed as warp chains which are bridged only by the filler or weft. As indicated the sole connecting threads or yarns between the warp chains are the laid-in weft filaments or yarns which extend over four warp chains each so that four such weft inlays fill each warp loop to provide the transverse stability of the tape (stability in the plans of the tape perpendicular to the warp chains) and, in addition, prevent longitudinal extension and contraction (change of dimension in the plane of the tape parallel to the warp chains). The dimensional stability is most pronounced if the tapes are composed of synthetic-resin yarn. which has been thermofixed, i.e. subjected to a heating or ultrasonic treatment which relaxes internal stresses within the yarn.

The advantage of single-bar warp chains, i.e. individual spaced apart wales of loops interconnected only by the weft, is that channels are formed between wales so that the row of stitching for attaching the coupling element can lay along one of these channels or valleys.

While such an arrangement has proven itself relatively desirable it has been found to be advantageous to operate the sewing machine which secures the coupling element to the tape edge at still higher rates of speed. Furthermore, such a knit does not fully utilize the capacities of the industrially normally used warp-knit machine, so that capacity is lost.

OBJECT OF THE INVENTION

It is therefore an object of this invention to provide an improved slide-fastener stringer half.

Another object is to provide such an article of manufacture which overcomes the above-given disadvantages.

Yet another object is to provide a slide-fastener stringer half such as more fully to utilize a standard warp-knit machine.

SUMMARY OF THE INVENTION

These objects are attained according to the present invention in a slide-fastener stringer half of the above-described general type, but wherein the support tape is made of a plurality of warp yarns forming longitudinally extending parallel wale-forming chains or pillars, of a first group of weft yarns laid into and each extending over only three of the chains, and of a second group of weft yarns laid into and each extending over only three of the chains, and of a second group of weft yarns laid into and each extending over only two of the chains. The two groups of weft yarns thus overlap or are superimposed over the width of the tape. The stitching that overlies the turns of the coupling element extends through the tape and has a needle thread on the opposite end of the tape which lies between two adjacent wales formed by the chain at the respective tape edge.

According to further features of this invention the two groups of weft yarns are laid in with the same lap or pattern. It is also possible according to this invention, particularly when the stitching speed is to be maximized, to lay the two groups of weft yarns in with opposite lap, thereby leaving the channel or groove between the two end wales on the tape relatively open. Thus in this latter case in each course of the tape the weft yarns of one group will run in the direction opposite that of the weft yarns of the other group.

With such an arrangement it is possible to produce a warp-knitted tape which utilizes fully a modern warp-knitting machine. Furthermore, the tape will have extremely good longitudinal and transverse stability and it will be possible to sew the coupling element onto it with extremely high speed. It is possible, according to another feature of this invention, to increase the dimensional stability of the tape by making it at least partially of shrinkable yarns and shrinking these yarns, preferably thermally, so as to set the tape.

More specifically, the warp-chain-forming yarns and the weft-forming yarns can be composed of shrinkable yarns or threads of synthetic resin and, subsequent to the knitting of the tape, can be thermofixed.

Alternatively, the warp-chain-forming yarns or the weft-forming yarns can be composed of shrinkable synthetic-resin yarns or threads and, subsequent to the knitting of the tape, can be thermofixed.

Preferably, the warp-chain-forming yarns at least are thermofixed.

It is possible according to this invention to use filaments of all substantially the same gauge or weight. Thus a relatively smooth but still extremely strong tape is produced.

BRIEF DESCRIPTION OF THE DRAWING

The above and other objects, features and advantages of the present invention will become more readily apparent from the following, description reference being made to the accompanying drawing, in which.

SPECIFIC DESCRIPTION

Figure 1:
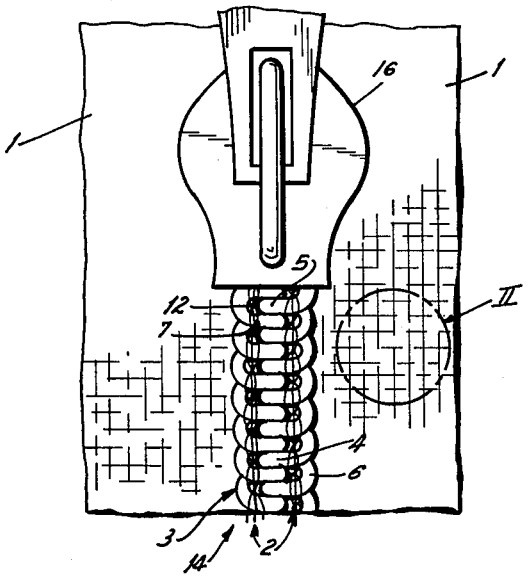
FIG. 1 is a top view of a portion of a slide fastener stringer half according to this invention.
Figure 6:
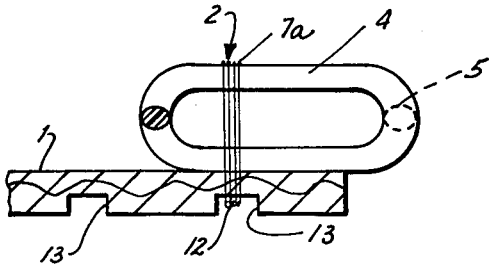
FIG. 6 is a diagrammatic section transverse to the plane of the tape at the coupling edge.

The slide-fastener stringer shown in FIG. 1 comprises a pair of stringer halves each constituted by a support tape 1 to which a helicoidal monofilamentary coupling element 3 is secured by means of stitching 2. This stitching 2 is formed as type 402 double-lock stitching and has looper threads 2*a* which overlie the superposed legs 4 of the turns constituting the coupling elements 3. The two legs 4 of each turn have congruent (coextensive) projections on the fastener plane and lie in a plane perpendicular to the longitudinal axis of the coil and are connected together at one end at a coupling head 5 which is somewhat flattened to ensure good interengagement of the two halves, and at their other ends the turns are connected together by means of connecting bights 6. Thus the looper threads 7 of the stitching 2 overlie only the shanks or legs 4. After assembly the two stringer halves are secured together at their ends and a slider 16 is fitted to them along with end-stop members in order to make a complete slide fastener.

Figure 2:
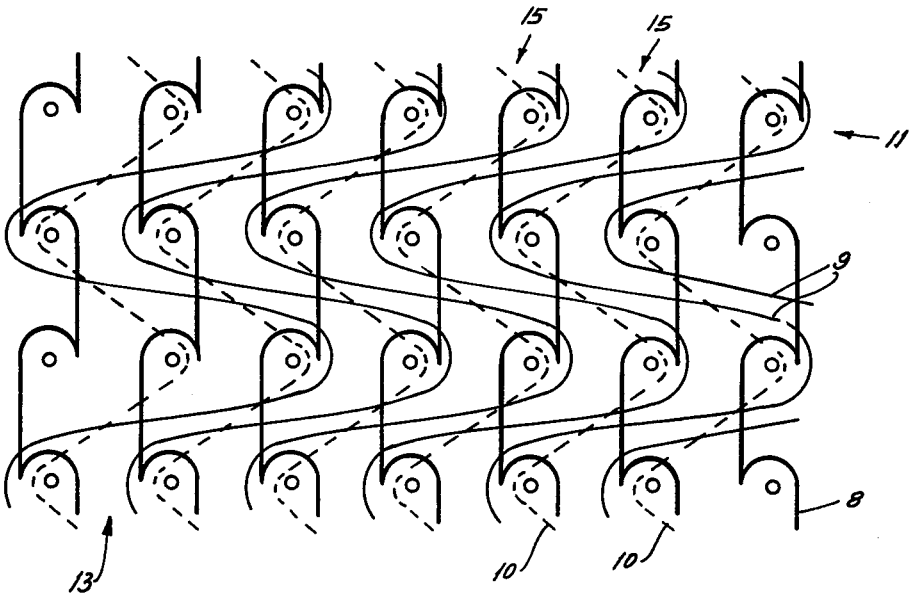
FIG. 2 is a largely diagrammatic view of the detail indicated by arrow II of FIG. 1.
Figure 3:
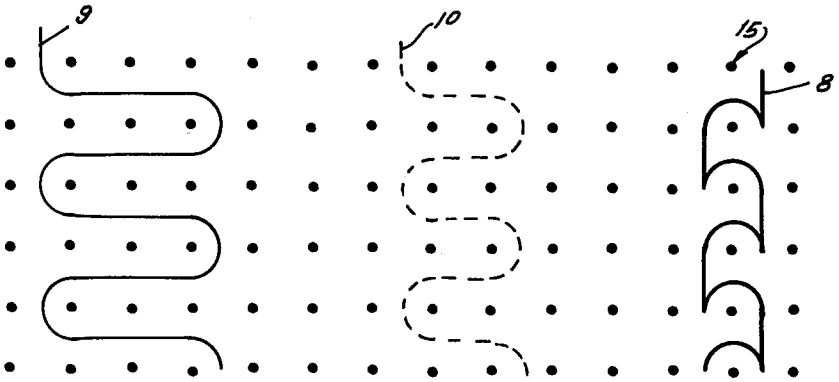
FIG. 3 is a point-paper diagram illustrating the patterns of the yarns forming the support tapes of the slide-fastener stringer half of this invention.

FIGS. 2 and 3 show how each of the tapes 1 is formed by a plurality of warp yarns 8, a plurality of first weft yarns 9, and a plurality of second weft yarns 10. The warp filaments 8 are formed into simple longitudinally extending chains or pillars of open loops that form wales 15 separated by gaps or valleys 13. The loops of the chains constituting the wales 15 form courses 11. The weft filaments 9 and 10 are both laid in. The yarn 8–10 are patterned in the following pattern:

First weft yarns 9 — 0–0/3–3,
Second weft yarns 10 — 0–0/2–2, and
Warp yarns 8 — 1–0/0–1.

Thus the yarns 9 extend over three wales 15 and the yarns 10 over 2 wales 15. The yarns 9 and 10 as shown in FIG. 3 are lapped in the same direction.

Figure 4:
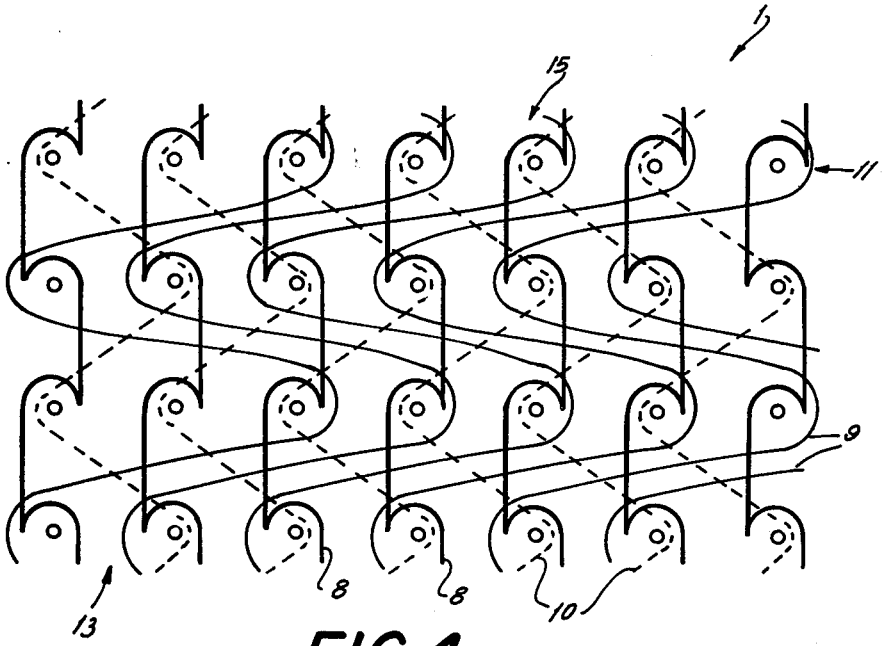
FIGS. 4 and 5 are views similar to FIGS. 2 and 3, respectively, illustrating another warp-knit tape according to this invention.
Figure 5:
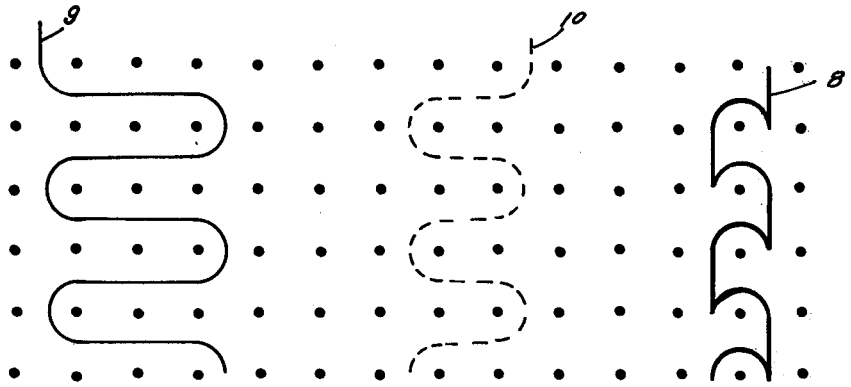

The arrangement shown in FIGS. 4 and 5 is identical to that shown in FIGS. 2 and 3, except that here the yarns 9 and 10 are oppositely lapped. Thus the pattern is the following:

Weft yarns 9 — 0–0/3–3,
Weft yarns 10 — 2–2/0–0, and
Warp yarns 8 — 1–0/0–1.

The yarns 8 10 may be of natural or synthetic material. Preferably they are of a synthetic-resin material which can be heat-shrunk, so that after manufacturing as shown in FIG. 4 the tapes 1 are shrunk and thermoset.

Furthermore, in accordance with the present invention the yarns are all of substantially the same weight or gauge so that a very smooth tape 1 can be produced from them.

When the tape 1 is manufactured, the coupling element 3 is positioned on the edge 14 of it. The stitching is passed through it so that the looper threads 7 overlie the shanks 4 and the needle threads 12 pass through the tapes 1 (see the aforementioned patent and application) and lie on one of the valleys 13 adjacent the edge wale 15. It is possible with this system to stitch the element 3 very rapidly to the tape 1 for highest production speed.

I claim:

1. A slide-fastener stringer comprising a pair of support tapes warp-knitted with a plurality of warp yarns forming longitudinally extending wale-forming warp pillars in the form of chains, a first group of weft yarns extending over the entire width of the respective tape and each laid into and extending over three of the warp chains of the respective tape in passing from course to course, and a second group of weft yarns laid into the warp chains of each tape over the entire width thereof and each comprising a weft yarn extending over and laid into two such chains in passing from course to course, said groups being mutually superimposed inlaid wefts, a respective continuous monofilament coupling element having a succession of turns and lying along one face of the respective tape for interdigitation with a coupling element on the corresponding face of the other tape upon movement of a slider along said coupling elements; and respective rows of stitching overlying the turns of the respective coupling elements and extending through the respective tape while having needle threads on the face of the tape opposite that along which the coupling elements are provided and lying between two wales formed by the respective warp pillars at edges of the respective tapes, each tape consisting exclusively of the respective said warp and weft yarns.

2. The stringer defined in claim 1 wherein said groups of weft yarns are laid in with the same lap.

3. The stringer defined in claim 1 wherein said groups of weft yarns are laid in with opposite lap.

4. The stringer defined in claim 1 wherein all of said yarns are of approximately of the same gauge.

5. The stringer defined in claim 1 wherein at least some of said yarns are shrunk.

6. The stringer defined in claim 1 wherein the wale-forming warp yarns are laid in a 1–0/0–1 pattern, the yarns of said first group are laid in a 0–0/3–3 pattern and the yarns of said second group are laid in 0–0/2–2 or 2–2/0–0 pattern.

* * * * *